US008847674B1

(12) United States Patent
Alley

(10) Patent No.: US 8,847,674 B1
(45) Date of Patent: Sep. 30, 2014

(54) SYSTEMS AND METHODS FOR POWER LIMITING FOR A PROGRAMMABLE I/O DEVICE

(71) Applicant: General Electric Company, Schenectady, NY (US)

(72) Inventor: Daniel Milton Alley, Earlysville, VA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/801,214

(22) Filed: Mar. 13, 2013

(51) Int. Cl.
*G05F 1/10* (2006.01)
*G05F 3/02* (2006.01)

(52) U.S. Cl.
CPC ..... *G05F 3/02* (2013.01)
USPC ..... 327/538

(58) Field of Classification Search
CPC ..... G05F 1/565; G05F 1/573
USPC ..... 327/309, 318, 331, 538
See application file for complete search history.

(56) References Cited

U.S. PATENT DOCUMENTS 3,769,572 A 10/1973 Doubt
4,200,898 A 4/1980 Thompson
4,396,882 A 8/1983 Kellenbenz
4,744,369 A 5/1988 Kroll
5,006,734 A 4/1991 Engelbrecht
5,579,236 A * 11/1996 Tamamura et al. ..... 702/64
5,742,463 A 4/1998 Harris
6,118,641 A 9/2000 Atkins et al.
6,121,787 A * 9/2000 Jacobson et al. ..... 324/762.01
6,970,337 B2 11/2005 Strahm
7,106,569 B2 * 9/2006 Liu et al. ..... 361/93.1
7,324,315 B2 1/2008 Harris
7,574,321 B2 8/2009 Kernahan et al.
7,903,008 B2 * 3/2011 Regier ..... 341/142
8,001,401 B2 8/2011 Bellofatto et al.
8,225,123 B2 7/2012 Gupta et al.
8,395,359 B2 * 3/2013 Ashida ..... 320/162

* cited by examiner

*Primary Examiner* — Jeffrey Zweizig
(74) *Attorney, Agent, or Firm* — Fletcher Yoder, P.C.

(57) ABSTRACT

A device includes a digital to analog converter (DAC) configured to generate a voltage output or a current output. The device also includes an integrated circuit configured to receive at least one of the voltage output or the current output and transmit the at least one of the voltage output or the current output to a load, wherein the integrated circuit is configured to measure a voltage level or a current level related to the transmission of the at least one of the voltage output or the current output. In one embodiment, a current limiter is included for voltage outputs as a form of power limiting and circuit protection. Additionally, the device includes a controller configured to receive an indication of the measurement from the integrated circuit and determine if the indication of the measurement exceeds a predetermined threshold.

17 Claims, 4 Drawing Sheets

SYSTEMS AND METHODS FOR POWER LIMITING FOR A PROGRAMMABLE I/O DEVICE

BACKGROUND

The subject matter disclosed herein relates to power limiting for a programmable input/output (I/O) device, and more particularly, to systems and methods for monitoring and limiting current in a digital-to-analog converter (DAC) and application specific integrated circuit (ASIC) I/O device.

Control systems, such as programmable logic controllers (PLCs) and distributed control systems (DCSs) often include a programmable input/output (I/O) device which includes an application specific integrated circuit (ASIC) for switching signals between user terminals and a digital-to-analog converter (DAC) with both current and voltage outputs. When the DAC is in a voltage output mode, the DAC maintains a constant voltage output to a load. The constant voltage output of the DAC behaves as a voltage source, varying the output current in relation to the load impedance in order to keep the output voltage constant. In the case that the load is shorted, a large amount of current may flow from the DAC, potentially damaging and/or overheating the DAC as well as the ASIC. Additionally, certain load types may draw a large amount of power through the programmable I/O device, also leading to damage of the device, or a device that contains the programmable I/O device.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In one embodiment, a device includes a digital to analog converter (DAC) configured to generate a voltage output or a current output, an integrated circuit configured to receive at least one of the voltage output or the current output and transmit the at least one of the voltage output or the current output to a load, wherein the integrated circuit is configured to measure a voltage level or a current level related to the transmission of the at least one of the voltage output or the current output, and a controller configured to receive an indication of the measurement from the integrated circuit and determine if the indication of the measurement exceeds a predetermined threshold.

In another embodiment, a method includes, receiving via an integrated circuit at least one of the voltage output or the current output, transmitting via the integrated circuit the at least one of the voltage output or the current output to a load, measuring via the integrated circuit a voltage level or a current level related to the transmission of the at least one of the voltage output or the current output, generating via the integrated circuit an indication of the measurement of the voltage level or the current level, and determining via a controller whether the indication exceeds a predetermined threshold.

In a further embodiment, a device includes a controller configured to receive a first indication related to a short circuit in the device related to transmission of power to a load, receive a second indication related to the temperature of the device related to power dissipation in the device, determine whether either the first indication exceeds a first threshold or the second indication exceeds a second threshold, and generate an alarm signal when either the first indication exceeds the first threshold or the second indication exceeds the second threshold.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in further detail below, present embodiments relate to a programmable logic controller (PLC) input/output (I/O) device for a control system which uses an application specific integrated circuit (ASIC) for switching signals between user terminals, a digital-to-analog converter (DAC) with current and voltage outputs, and a sensing analog-to-digital converter (ADC). In certain embodiments, the ASIC supports measurements of current and terminal voltage in order to detect a shorted connection. For example, an unexpectedly high current flowing through a channel may indicate a shorted connection. The ADC receives inputs that are analyzed by a controller for proper power consumption management. The inputs allow the controller to detect shorts, reduce power, and calculate power dissipation of a device for comparison to thermal limits based on the sensed device operating temperature. Based on the measurements performed by the ASIC, the controller can limit the number of devices assigned to an output mode, effectively limiting the power dissipation. Power limiting may also be performed in hardware by implementing a current limiter on one or more outputs of the DAC. The current limiter may limit the output current of the DAC to a value that will not damage the circuitry of the PLC I/O device, the device housing the PLC I/O device, or other surrounding circuitry.

Figure 1:
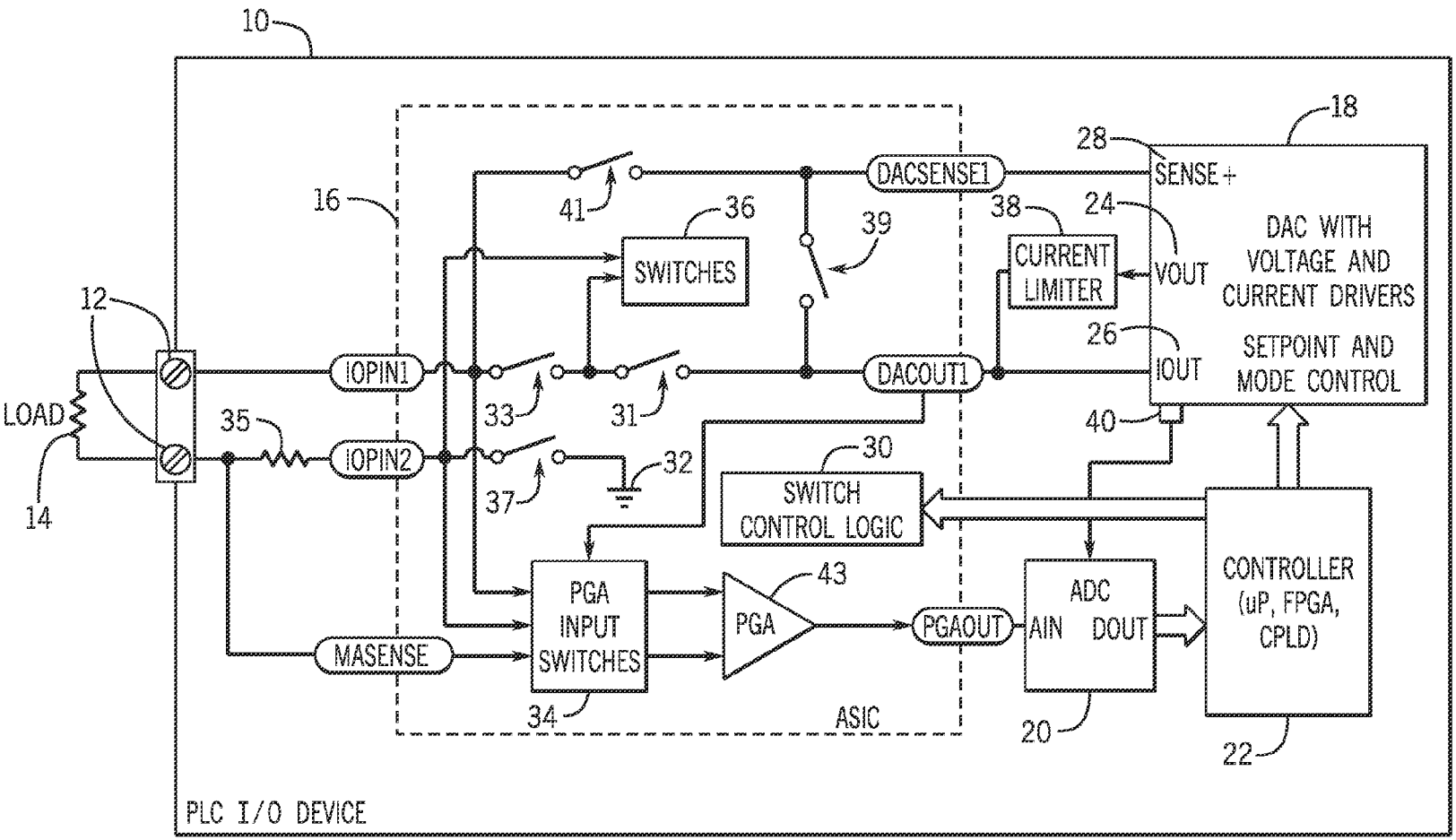
FIG. 1 illustrates a programmable logic controller (PLC) input/output (I/O) device in accordance with embodiments of the present disclosure.

With the foregoing in mind, it may be useful to describe an embodiment of the PLC I/O device, such as the PLC I/O device 10 illustrated in FIG. 1. The PLC I/O device 10 may include screw terminals 12, which may allow external loads 14, such as the illustrated resistor, to be electrically coupled to the PLC I/O device 10. In other embodiments, the resistor may be replaced by other external loads 14, such as control circuitry, communication circuitry, display circuitry, or a combination thereof. The PLC I/O device 10 may also include an ASIC 16 which may be configured to provide multiple input or output paths for the PLC I/O device 10, a DAC 18 configured to output signals, an ADC 20 configured to receive input signals, and a controller 22 configured to receive inputs from the ADC 20 and issue control and output signals to the DAC 18 and components on the ASIC 16. In certain embodiments, the DAC 18 may include voltage and current drivers and corresponding voltage outputs 24 and current outputs 26. The DAC 18 may also include a voltage sense input 28 configured to measure feedback voltage and determine if the voltage and current drivers are operating as expected. In certain embodiments, the DAC 18 may make adjustments to the voltage outputs 24 and the current outputs 26 based on the feedback voltage measured at the voltage sense input 28.

In order to provide multiple input or output paths for the PLC I/O device 10, the ASIC 16 may include a plurality of switches and switch control logic 30. The switch control logic 30 may receive commands from the controller 22 and open or close the plurality of switches on the ASIC 16 in response to the commands. In certain embodiments, the switch control logic 30 may be implemented with a programmable gate array (PGA) that includes programmable logic components. In the illustrated embodiment, switches 31, 33, 37, 39, and 41 may be opened or closed in specific configurations to allow the PLC I/O device 10 to carry out a variety of operations. By way of example, in order to output a signal from the DAC 18 to the external load 14, switches 31 and 33 may be closed to provide a current path from the output of the DAC 18 to one of the screw terminals 12, while switch 37 may be closed to provide a current path between ground 32 and the other one of the screw terminals 12. In other embodiments, switch 39 may be closed so that the DAC 18 may receive feedback from the voltage outputs 24 and the current outputs 26 to the voltage sense input 28.

The ASIC 16 may additionally include one or more programmable gate array (PGA) input switches 34 that may select one or more outputs from multiple inputs. In certain embodiments, such as the illustrated embodiment, the ASIC 16 may include multiple levels of PGA input switches 34. The output from the PGA input switches 34 may be passed to the ADC 20 via a PGA 43 to be converted to a digital signal that the controller 22 may input and analyze. The PGA 43 may operate to select one of the one or more inputs from the PGA input switches 34, for example, through differential measurements of the signals received from the PGA input switches 34. After receiving signals from the ADC 20, the controller 22 may output control signals to both the DAC 18 and the switch control logic 30. In certain embodiments, a single controller 22 may issue output control signals to one or more PLC I/O devices 10.

In addition to outputting signals to the external load 14, the PLC I/O device 10 may be able to measure voltages across the screw terminals 12. In certain embodiments, switch 37 may be closed to provide a voltage measurement with respect to ground. Thus, in the illustrated embodiment, the PLC I/O device 10 includes a sensing resistor 35 that may form a voltage bias with respect to ground 32 as current flows through the sensing resistor 35 when switch 37 is closed. Based on the voltage measured across the sensing resistor 35 (represented in FIG. 1 as MASENSE), the controller 22 may determine the current flowing through the screw terminals 12. In other embodiments, switch 37 may remain open to provide a floating reference voltage measurement between the screw terminals 12. In addition to the illustrated switches, the ASIC 16 may include one or more additional switches 36 that may be configured by the switch control logic 30 to provide input and output paths to other external loads 14 and/or other ASIC 16 circuitry.

As mentioned above, the voltage output 24 of the DAC 18 may be designed to provide a constant output voltage. However, in the case of a short circuit, a potentially damaging amount of current may flow out of the voltage output 24. The current may damage the circuitry of the PLC I/C device 10. In order to protect the circuitry of the PLC I/C device 10, the PLC I/C device 10 may include a current limiter 38 that may limit the current flowing from the DAC 18 to a predetermined level. In addition to the current limiter 38, the ASIC 16 may intermittently take voltage measurements to determine if shorts have formed in the circuit or across the external load 14. In some embodiments, the controller 22 may generate signals that cause the ASIC 16 to take these voltage measurements. Moreover, the controller 22 may receive the results of the measurements and utilize the voltage measurements to calculate the power dissipation of the PLC I/O device 10. Additionally, after receiving the measurement data, the controller 22 may apply predetermined rules, for example, to limit the number of PLC I/O devices 10 set to an output mode to limit total power dissipation. Additionally, various components of the PLC I/O device 10 may include one or more temperature sensors 40 that may provide analog signals to the ADC 20. Although the illustrated temperature sensor 40 is coupled to the DAC 18, other embodiments may include temperature sensors 40 disposed throughout the PLC I/O device 10, or within a device that houses the PLC I/O device 10. The controller 22 may, in some embodiments, compare the calculated power dissipation to measured temperature data to determine if the PLC I/O device 10 is operating as expected.

As previously noted, the controller 22 may apply predetermined rules based on the measured currents and voltages within the PLC I/O device 10. As mentioned above, the controller 22 may determine the power dissipation within the PLC I/O device 10 and monitor voltages in the PLC I/O device 10 to insure the voltages are within tolerance levels. Additionally, the controller 22 may transmit signals to activate a series of alarms to warn a user that the power dissipation for a given temperature of the device containing the PLC I/O device 10 is too high. Some alarms may indicate when power dissipation is too high, but the device may continue to operate at the present power dissipation for an extended amount of time (e.g. several hours). Additional alarms may indicate power dissipation levels that allow for only allow a short duration of operation of the device (i.e., that the device needs to be powered down). Moreover, in certain embodiments, the DAC 18, the ASIC 16, or a combination thereof may include internal temperature sensors that may shut down the PLC I/O device 10 when the temperature of the components reaches predetermined temperature limits (e.g. die temperature approaching 125 degrees Celsius). If the PLC I/O device 10 is shut down, an additional set of alarms may be set off to notify the users of thermal overload.

Figure 2:
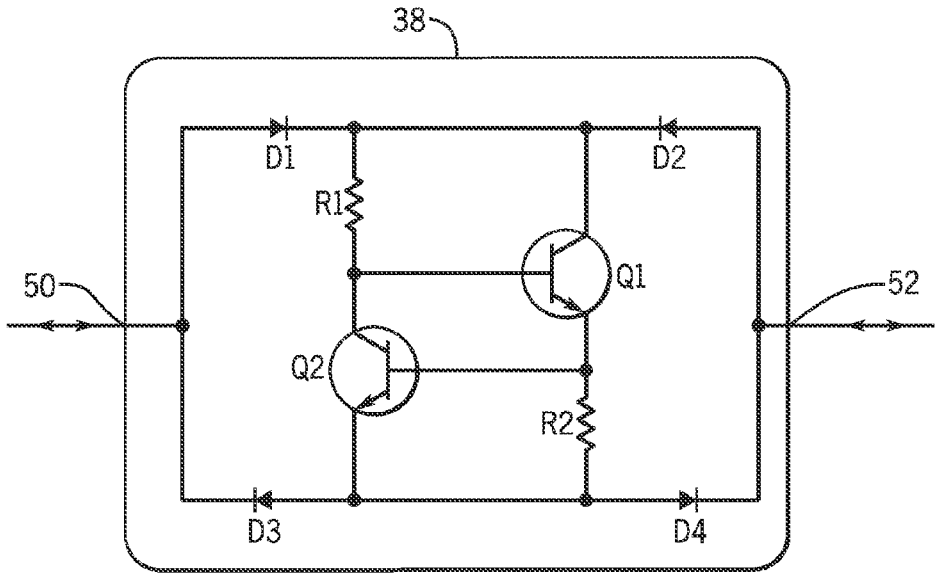
FIG. 2 is a circuit-level diagram of the current limiter illustrated in FIG. 1, in accordance with embodiments of the present disclosure.

Turning to FIG. 2, a certain embodiment of the current limiter 38 of FIG. 1 is illustrated. In the illustrated embodiment, the current limiter 38 includes diodes D1, D2, D3, and D4, transistors Q1 and Q2, and resistors R1 and R2. Transistors Q1 and Q2 may be bipolar junction transistors (BJTs), metal-oxide-semiconductor field-effect transistors (MOSFETs), or any other type of transistor. Resistors R1 and R2 may have a range of resistance values that may determine the characteristics of the current limiter 38. In certain embodiments, resistor R1 may have a larger resistance than resistor R2. In certain embodiments, the ratio of R1 to R2 may be 5 to 1, 10 to 1, 100 to 1, 1000 to 1, or another ratio. The illustrated current limiter 38 is bidirectional, meaning that it may limit current flowing either way through the circuitry. In one embodiment, during operation, a current may flow into the current limiter 38 on a first terminal 50. This inputted current may flow through diode D1 and thorough resistor R1. Once the current flows through R1, a voltage bias may form across terminals of transistor Q1, allowing current to flow through transistor Q1, and subsequently, through resistor R2 and diode D4 before being output through a second terminal 52.

If, for example, the current flowing into the current limiter 38 from terminal 50 reaches a certain level, a voltage bias may form across resistor R2, and current may flow through transistor Q2. This current flowing through transistor Q2 shunts the current from R1 normally flowing into Q1's base, reducing the current flowing through Q1 to effectively limit the current. As previously noted, the resistance value of resistor R2 may be smaller than the resistance value of resistor R1. Utilizing a smaller resistance value for resistor R2 may increase the amount of current that may flow through the current limiter 38 before the current is limited. Thus, through tuning the value of resistor R2, control of the current levels which are limited may be accomplished. In certain embodiments, resistor R2 may be chosen before it is placed into the current limiter 38 circuit. In other embodiments, resistor R2 may be a variable resistor, such as a potentiometer, that may be fine tuned after it has been placed in the current limiter 38 circuit. Additionally, it may be appreciated that alternative circuits to current limiter 38 of FIG. 2 may be utilized to limit the current, for example, from voltage output 24 of DAC 18. That is, the circuit configuration illustrated in FIG. 2 is not meant to be exclusive of other circuit configurations. And it is envisioned that other circuits are available to form, for example, a bidirectional current limiter. Additionally, other circuit configurations may utilize, for example, field effect transistors, bipolar transistors, Schottky diodes, and/or general silicon diodes.

Figure 3:
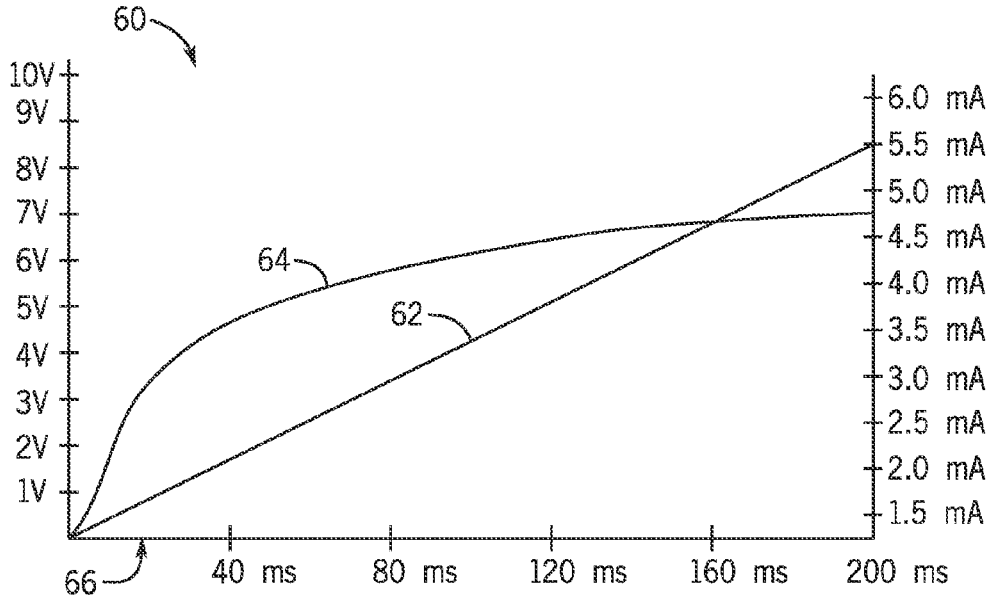
FIG. 3 is a plot illustrating the relation between the voltage across the current limiter and the current flowing through the current limiter in accordance with embodiments of the present disclosure.

The plot 60 of FIG. 3 illustrates the relation between a voltage across the current limiter 38 and the current flowing through the current limiter 38 for a period of time. The plot 60 includes a voltage curve 62 which represents the voltage formed across the current limiter 38, and a current curve 64 which represents the current flowing through the current limiter 38 with respect to the time on the time axis 66. As can be clearly seen, the current curve 64 initially rises sharply, indicating the region where transistor Q1 allows current to flow. However, once the current reaches a certain level, transistor Q2 turns on (shunting Q1's base current) and the current curve levels out. Even as the voltage curve 62 continues to steadily increase, the current curve 64 continues to level out, thus illustrating the limiting of current flowing through the current limiter 38.

Figure 4:
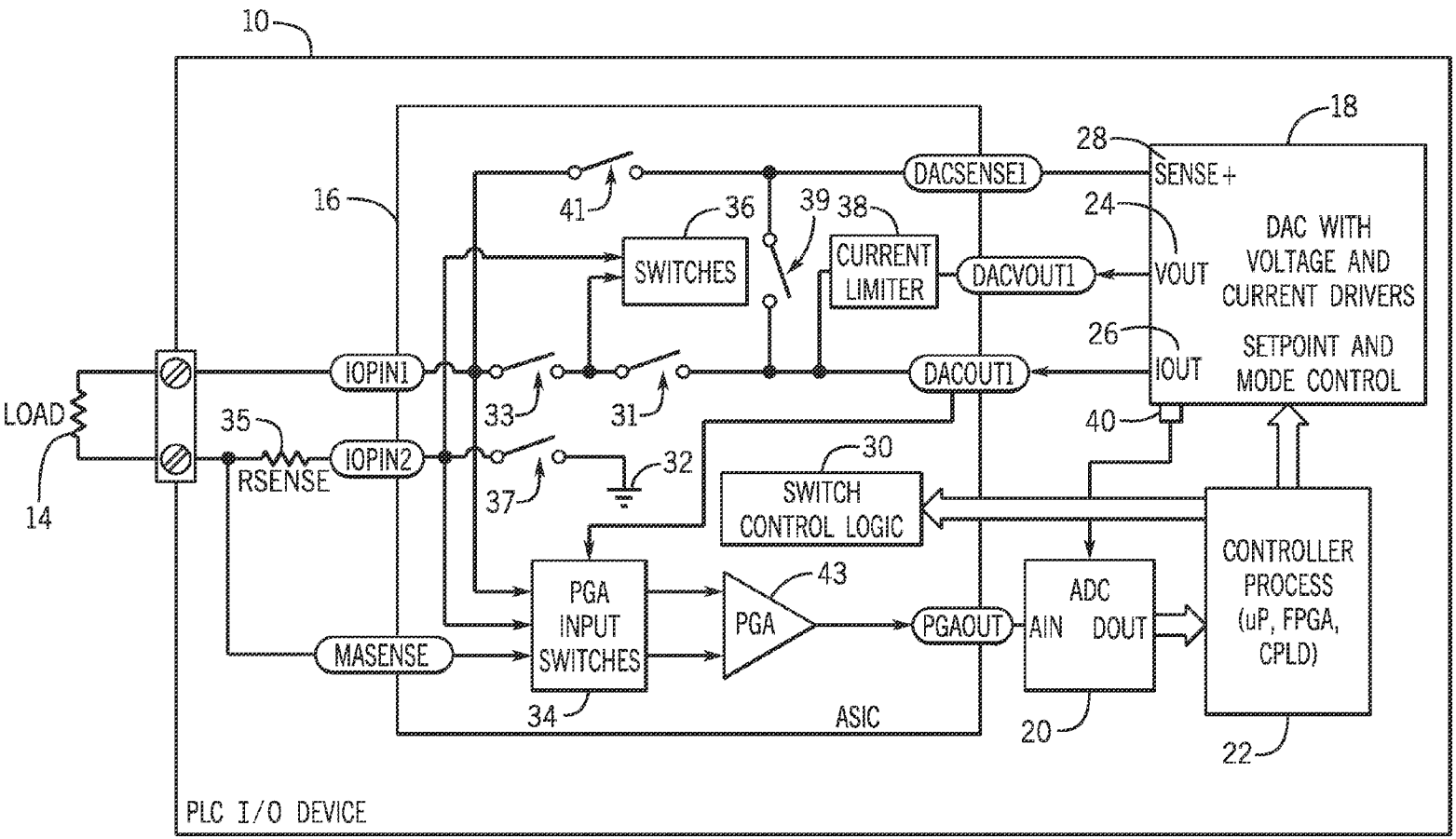
FIG. 4 is an alternative embodiment of the PLC I/O device illustrated in FIG. 1 in accordance with embodiments of the present disclosure.

The PLC I/O device 10 of FIG. 1 illustrates the current limiter 38 external to the ASIC 16. However, in certain embodiments, such as the PLC I/O devices 10 illustrated in FIGS. 4 and 5, the current limiter 38 may be disposed in the ASIC 16 so as to reduce complexity (e.g., the number of individual components) present in the PLC I/O device 10 and/or the overall size of the PLC I/O device 10.

Figure 5:
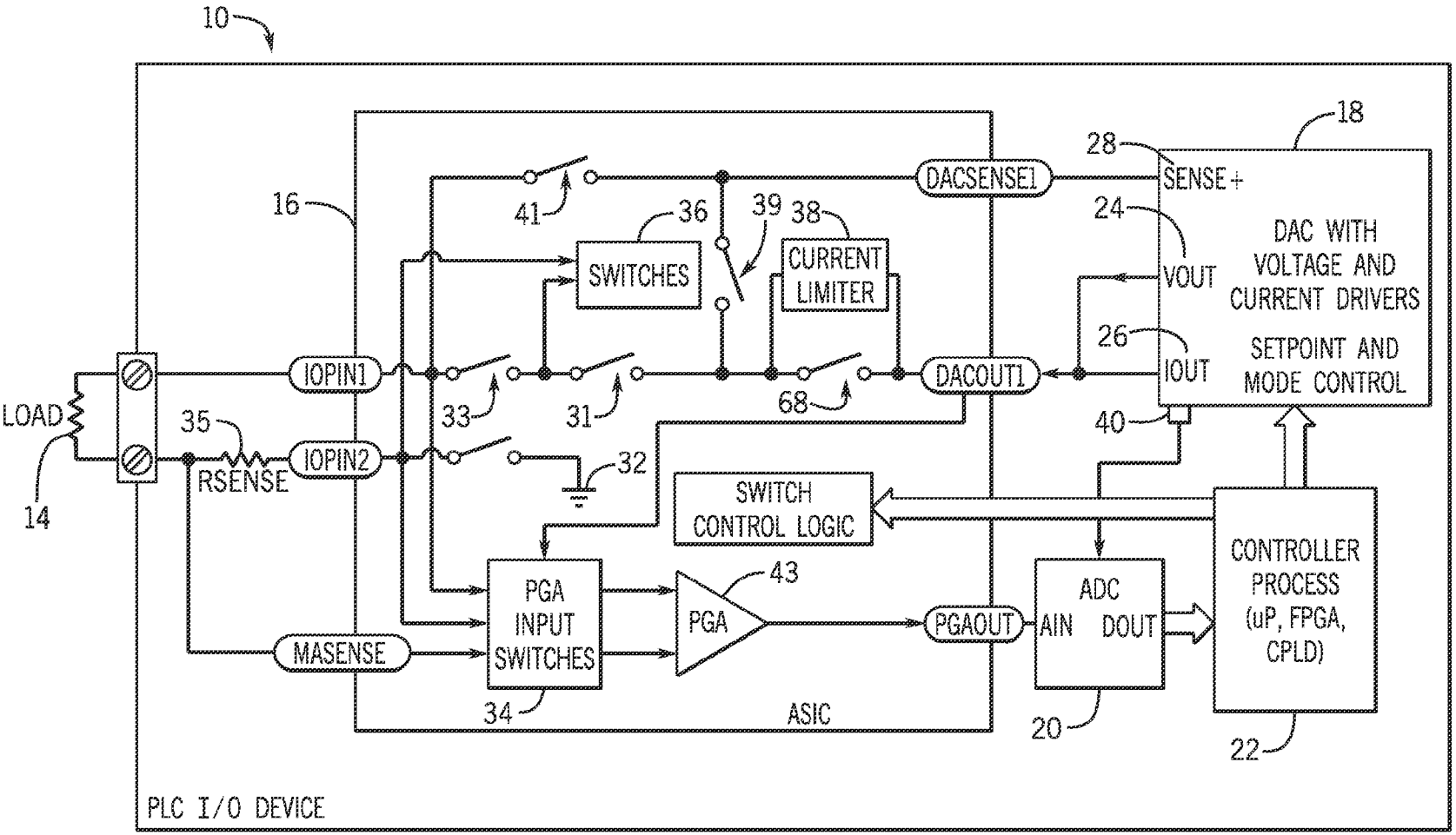
FIG. 5 is an alternative embodiment of the PLC I/O device illustrated in FIGS. 1 and 4 in accordance with embodiments of the present disclosure.

Additionally, in certain embodiments, such as the embodiment illustrated in FIG. 5, the voltage output 24 and the current output 26 may feed to a single I/O pin in order to reduce the number of I/O pins on the ASIC 16. This may allow for the benefits of incorporating the current limiter 38 into the ASIC 16, while reducing the pin count for ASIC 16. This may be advantageous as pins for the ASIC 16 may be relatively sparse in availability. In certain operating modes, such as when the DAC 18 of FIG. 5 is operating in current output mode, a bypass switch 68 may be closed to bypass the current limiter 38. In other embodiments, such as when the DAC 18 is operating in voltage output mode, the bypass switch 68 may be closed to limit the output current. This allows for the configuration of the PLC I/O device 10 illustrated in FIG. 5 to perform all functions in a manner similar to the PLC I/O device 10 of FIGS. 1 and 4, without an increase in pins for the ASIC 16.

Technical effects of the present application include one or more programmable I/O devices 10 that include an ASIC 16 for switching signals between components and I/O terminals, a DAC 18 with current and voltage outputs, and an ADC 20. The ASIC 16 supports voltage and current measurements and outputs the analog measurement signals to the ADC 16 and a controller 22, which may be assigned to multiple I/O devices 10. Based on the measurements, the controller 22 may limit the number of devices assigned to output mode to limit the power dissipation. In certain embodiments, a device that houses the PLC I/O device 10 may include temperature sensors 40 that may monitor the operating temperature of the PLC I/O device 10 and/or the device that houses the PLC I/O device 10. After analyzing the voltage, current, and/or temperature data, the controller 22 may set off a series of alarms if the PLC I/O device 10 is operating with a power dissipation that could potentially damage the circuitry of the PLC I/O device 10. Additionally, the controller 22 may determine if shorts exist in the circuitry of the PLC I/O device 10 and respond accordingly (e.g., issuing alarms and/or shutting down the PLC I/O device 10 or the device that houses the PLC I/O device 10). Moreover, if a short occurs while the DAC 18 is operating in voltage output mode, a current limiter 38 may limit the current flowing through the PLC I/O device 10 to an acceptable level.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A device comprising:

a digital to analog converter (DAC) configured to generate a voltage output or a current output;

an integrated circuit configured to receive at least one of the voltage output or the current output and transmit the at least one of the voltage output or the current output to a load, wherein the integrated circuit is configured to measure a voltage level or a current level related to the transmission of the at least one of the voltage output or the current output; and a controller configured to receive an indication of the measurement from the integrated circuit and determine if the indication of the measurement exceeds a predetermined threshold.

2. The device of claim 1, comprising a current limiter configured to limit a current associated with the voltage output from the DAC to a particular level.

3. The device of claim 2, wherein the particular level is a preset value based on fixed characteristics of circuitry of the current limiter.

4. The device of claim 2, wherein the particular level is an adjustable value based on adjustable characteristics of circuitry of the current limiter.

5. The device of claim 2, wherein the integrated circuit comprises the current limiter.

6. The device of claim 5, wherein the integrated circuit comprises a dedicated pin coupled only to an input of the current limiter and the DAC.

7. The device of claim 5, wherein the integrated circuit comprises a shared pin coupled to an input of the current limiter and to a switch configured to provide a path to bypass the current limiter.

8. The device of claim 1, wherein the controller is configured to generate and transmit a signal to activate an alarm when the measurement exceeds the predetermined threshold.

9. The device of claim 1, comprising a temperature sensor configured to measure a temperature present in the device and generate an indication of the measured temperature.

10. The device of claim 9, wherein the controller is configured to receive the indication of the measured temperature and deactivate the device when the indication exceeds a temperature threshold.

11. A method comprising:

receiving at an integrated circuit at least one of a voltage output or a current output from a digital to analog converter;

transmitting via the integrated circuit the at least one of the voltage output or the current output to a load;

measuring via the integrated circuit a voltage level or a current level related to the transmission of the at least one of the voltage output or the current output;

generating via the integrated circuit an indication of the measurement of the voltage level or the current level; and determining via a controller whether the indication exceeds a predetermined threshold.

12. The method of claim 11, comprising limiting via a current limiter a current associated with the voltage output to a particular level.

13. The method of claim 11, comprising generating and transmitting via the controller a signal to activate an alarm when the measurement exceeds the predetermined threshold.

14. The method of claim 13, wherein the alarm indicates a period of time at which a device housing the integrated circuit and the controller can continue to operate.

15. The method of claim 13, wherein the alarm indicates that a device housing the integrated circuit and the controller has been deactivated.

16. The method of claim 11, comprising measuring via a temperature sensor configured a temperature present in a device housing the integrated circuit and generating an indication of the measured temperature.

17. The method of claim 16, comprising deactivating the device when the indication exceeds a temperature threshold.

* * * * *